US005715800A

United States Patent [19]

März

[11] Patent Number: 5,715,800

[45] Date of Patent: Feb. 10, 1998

[54] LOAD ADJUSTMENT DEVICE FOR AN INTERNAL COMBUSTION ENGINE, IN PARTICULAR, OF A MOTOR VEHICLE

[75] Inventor: Uwe März, Eschborn, Germany

[73] Assignee: VDO Adolf Schindling AG, Frankfurt, Germany

[21] Appl. No.: 719,581

[22] Filed: Sep. 25, 1996

[30] Foreign Application Priority Data

Nov. 10, 1995 [DE] Germany ..... 195 41 884.0

[51] Int. Cl.[6] ..... F02M 23/00

[52] U.S. Cl. ..... 123/533; 123/630; 123/198 D

[58] Field of Search ..... 123/533, 630, 123/198 D, 198 DB, 148 C, 129 BG, 275

[56] References Cited

U.S. PATENT DOCUMENTS

| | | | |
|---|---|---|---|
| 4,193,385 | 3/1980 | Katsumata et al. | 123/198 DC |
| 4,531,500 | 7/1985 | Burson | 123/630 |
| 4,986,228 | 1/1991 | Tharman | 123/179 BG |
| 5,031,594 | 7/1991 | Morikawa | 123/339 |
| 5,076,250 | 12/1991 | Sasaki et al. | 123/630 |
| 5,085,189 | 2/1992 | Huang et al. | 123/275 |
| 5,190,019 | 3/1993 | Harvey | 123/630 |
| 5,345,903 | 9/1994 | Motose et al. | 123/198 DC |

*Primary Examiner*—Raymond A. Nelli
*Attorney, Agent, or Firm*—Martin A. Farber

[57] ABSTRACT

A load adjustment device, intended for an internal combustion engine of a motor vehicle, has a desired-value transmitter actuatable by means of an accelerator pedal. The accelerator pedal has a safety contact which opens when the idle position of the accelerator pedal is reached. This safety contact is connected directly to an actuator, thus circumventing a control electronics system of the load adjustment device, and preventing action on the actuator by the control electronics system.

5 Claims, 2 Drawing Sheets

LOAD ADJUSTMENT DEVICE FOR AN INTERNAL COMBUSTION ENGINE, IN PARTICULAR, OF A MOTOR VEHICLE

FIELD AND BACKGROUND OF THE INVENTION

The present invention relates to a load adjustment device for an internal combustion engine, in particular, of a motor vehicle, the device having a desired-value transmitter actuatable by an accelerator pedal. The device has a position transmitter connected with a control electronics, particularly a potentiometer, and a safety contact for producing an idle signal and, wherein, the control electronic is connected with an actuator serving for an adjustment of the load.

Such load adjustment devices are known by the name "E-gas" and are used in modern motor vehicles. In such devices, the safety contact serves to provide the control electronics with redundant information as to whether the idling position of the accelerator pedal has been reached. The control electronics then provides that the actuator, in particular a throttle valve, also assumes the idle position.

In motor vehicles there must be absolute assurance that the internal combustion engine drops back to its idle power when the driver allows the accelerator pedal to move back into the idle position so that the vehicle also actually reduces its speed in accordance with the wish of the driver and traffic requirements. However, the control electronics is able, regardless of the position of the accelerator pedal, to increase the power of the internal combustion engine. This is necessary upon idling, for instance, if various accessory devices such as air-conditioner or windshield heater are operated. Therefore, it is also conceivable, in the event of a malfunction of the control electronics, that a signal of the safety contact is improperly processed or not processed at all. Then the vehicle accelerates in the idle position of the accelerator pedal with gear engaged, which would lead to considerable irritation on the part of the driver and with risk of accident.

SUMMARY OF THE INVENTION

The object of the invention is to develop a load adjustment device of the aforementioned type which provides the greatest possible assurance against an unintentional increase in the power of the internal combustion engine of the motor vehicle in the idle position of the accelerator pedal.

According to the invention, the safety contact (9) is connected directly to the actuator (5, 17) circumventing the control electronics (4) and preventing action on the actuator (5, 17) by the control electronics (4).

By this development, actuation of the actuator is prevented by the safety contact independent of the correct operation of the control electronics. Therefore, there cannot be any increase in the power of the internal combustion engine even if the control electronics gives a command to this effect as a result of a malfunctioning. Aside from this safety advantage, the invention results in a simplification, and thus a reduction in the cost, of the control electronics.

In a motor vehicle in which the actuator has a servo= motor which is connected via a clutch with a throttle valve, unintended action on the throttle valve can be prevented most simply in the manner that the safety contact (9) acts to open the clutch (7) when the idle position of the accelerator pedal (1) is reached.

Upon braking, assurance can be had, regardless of the position of the accelerator pedal, that the internal combustion engine enters into idle position when the safety contact (9) opens the clutch (7) upon actuation of the brake pedal.

By means of the safety contact, if injection valves of the engine are suitably developed, the amount of fuel injected in idle position can also be limited if the safety contact (9) is developed so as to interrupt or limit the injection of fuel when the accelerator pedal (1) reaches the idle position. It is also possible, by such a development of the invention, to prevent too large an amount of unburned exhaust gas entering the exhaust catalytic converter, as a result of which the latter would be damaged. If the injection is positively limited in the idle position, then there is a reduction in an endangering of the operation of the catalytic converter by an injurious shoving of the motor vehicle.

In a load adjustment device for an internal combustion engine having an injection nozzle for each cylinder, the greatest possible assurance against an unintended increase in the power in the idle position of the accelerator pedal can be reached in simple manner. A central additional injection nozzle (15) is present for injecting an idling quantity of fuel, and the safety contact (9) interrupts the injection of all other injection nozzles (16). This arrangement of the central additional injection nozzle in addition to the injection nozzles of the cylinders furthermore guarantees a particularly uniform idling, which is substantially easier to regulate. The central additional injection nozzle provides better idling than operation with several injection nozzles due to the particularly small amount of fuel employed during idle. It is also advantageous that the internal combustion engine can be regulated excellently under load due to the injection nozzles which are provided for each cylinder. Furthermore, the control can be switched very rapidly from a load position to idling.

The invention permits numerous embodiments.

BRIEF DESCRIPTION OF THE DRAWINGS

With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
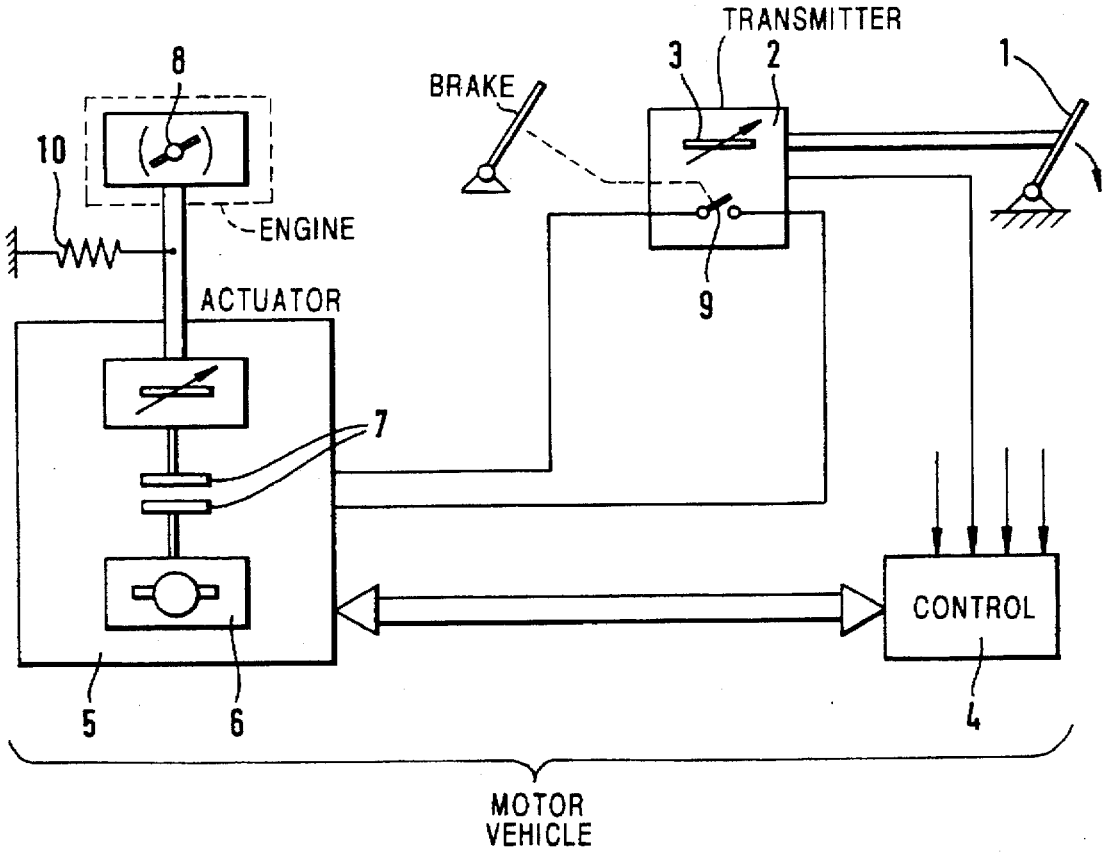
FIG. 1 is a load adjustment device with a throttle valve, intended for an internal combustion engine of a motor vehicle.

FIG. 1 shows components of a vehicle including an accelerator pedal 1 which is mechanically connected to a desired-value transmitter 2. The latter has, in this case, a potentiometer 3 which, as a function of the position of the accelerator pedal 1, feeds desired values for an actuator 5 to a control electronics 4. The actuator 5 displaces a throttle valve 8 of an engine by means of a servo-motor 6 via a clutch 7.

The desired value transmitter 2 has, in addition to the potentiometer 3, a safety contact 9 which is so connected to the actuator 5 that the clutch 7 opens when the safety contact 9 moves into open position. The opening of the safety contact 9, and thus also of the clutch 7, takes place as soon as the accelerator pedal 1 is in the idle position, or upon actuation of a brake pedal of the vehicle. A return spring 10 which acts on the actuator 5 then moves the throttle valve 8 positively back into its idle position.

Figure 2:
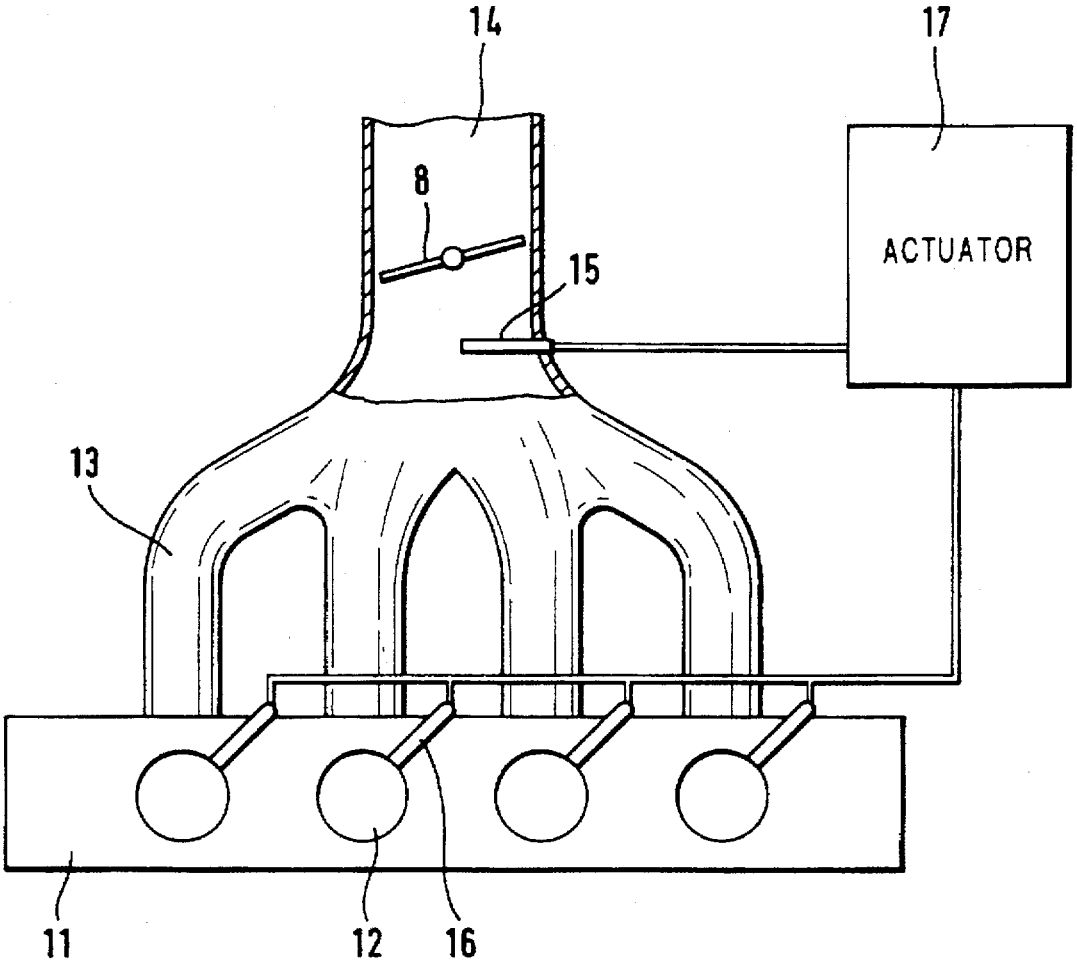
FIG. 2 is a load adjustment device for an internal combustion engine having several injection nozzles and one additional nozzle.

FIG. 2 shows an internal combustion engine 11 having four cylinders 12, each with a set of intake pipes 13 connected to respective ones of the cylinders. The intake pipes 13 lead to a central intake port 14 in which the throttle valve 8 and a central additional injection valve 15 are arranged. Each cylinder 12 has its own injection nozzle 16. The additional injection nozzle 15 and the injection nozzles 16 of the cylinders 12 are connected to an actuator 17 which is connected in a manner similar to the connection of the actuator 5 of FIG. 1.

The additional injection nozzle 15 is preferably always in operation and provides the internal combustion engine 11 with an amount of fuel required for idling, while the injection nozzles 16 arranged on the cylinders 12 enter into operation only upon additional loading. Upon an opening of the safety contact 9, or when a predetermined position of the accelerator pedal 1 is reached, the supply of fuel via the injection nozzles 16 to the cylinders 12 is interrupted. In this way, the internal combustion engine 11 is supplied with the idling quantity of fuel only via the additional injection nozzle 15.

I claim:

1. A load adjustment device for an internal combustion engine, suitable for use in a motor vehicle having an accelerator pedal, the device comprising;

a desired value transmitter including a position transmitter actuatable by the accelerator pedal, a control electronics connected to the desired-value transmitter, a safety contact within the desired-value transmitter for producing an idle signal, and an actuator connected to the control electronics for adjustment of a load;

wherein the safety contact is connected directly to the actuator, bypassing the control electronics and preventing action on the actuator by the control electronics.

2. A device according to claim 1, wherein the actuator comprises a clutch, and a servo-motor which is connected via the clutch to a throttle valve of the engine; and the safety contact opens the clutch upon attainment of the idle position by the accelerator pedal.

3. A device according to claim 1, wherein the safety contact opens the clutch upon actuation of the brake pedal.

4. A device according to claim 1, wherein the engine has injection valves, and the safety contact limits injection of fuel to the engine upon attainment of the idle position by the accelerator pedal.

5. A device according to claim 4, wherein the internal combustion engine has a plurality of cylinders, and respective ones of the engine injection nozzles are operative with respective ones of the cylinders of the engine, the device further comprising:

a central additional injection nozzle for injecting an idling quantity of fuel;

wherein the safety contact interrupts the injection of fuel to all of the other injection nozzles.

* * * * *